US006116296A

United States Patent [19]

Turunen

[11] Patent Number: 6,116,296

[45] Date of Patent: Sep. 12, 2000

[54] FILLING APPARATUS

[76] Inventor: Pentti Turunen, Vähänummentie 5, FIN-04440 Järvenpää, Finland

[21] Appl. No.: 09/180,833

[22] PCT Filed: May 15, 1997

[86] PCT No.: PCT/FI97/00284

§ 371 Date: Nov. 16, 1998

§ 102(e) Date: Nov. 16, 1998

[87] PCT Pub. No.: WO97/44246

PCT Pub. Date: Nov. 27, 1997

[30] Foreign Application Priority Data

May 21, 1996 [FI] Finland ..... 962144

[51] Int. Cl.[7] ..... B65B 1/04

[52] U.S. Cl. ..... 141/20; 141/351; 141/364

[58] Field of Search ..... 141/2, 3, 18, 20, 141/351, 364, 365, 95, 94, 83

[56] References Cited

U.S. PATENT DOCUMENTS 4,285,372 8/1981 Kieber ..... 141/20
5,092,750 3/1992 Leroy et al. ..... 141/20
5,645,113 7/1997 Humm et al. ..... 141/20

FOREIGN PATENT DOCUMENTS 633190 1/1995 European Pat. Off. .
28 45 479 4/1980 Germany .
92/12912 8/1992 WIPO .

*Primary Examiner*—Steven O. Douglas
*Attorney, Agent, or Firm*—Andrus, Sceales, Starke & Sawall, LLP

[57] ABSTRACT

Filling apparatus for filling a refillable aerosol package. The filling apparatus comprises a liquid container (1), a pump (2) with a power means (3), a nozzle (4) for passing liquid into the aerosol package (5), and a flow channel (6) for passing liquid from the liquid container into the nozzle. A control unit (7) is connected to the power means (3), a controlled valve (8) placed in the flow channel (6) before the nozzle (4), a flow meter (10) placed between the pump (2) and the valve (8), and a starter (11). The flow channel is provided with a flow restrictor (9) placed before the valve (8).

10 Claims, 2 Drawing Sheets

FILLING APPARATUS

BACKGROUND OF THE INVENTION

The present invention relates to a filling apparatus for the filling of refillable aerosol packages, as defined in the claims.

From international patent application WO 92/12912, a refillable aerosol package is known which consists of a pressure resistant cylindrical shell and an elastic or flexible container deformable by pressure, sealed against the edges of an aperture in the cover of the shell by means of a plug provided with a push valve as used in aerosol packages. The elastic or flexible container divides the interior of the aerosol package into two spaces hermetically sealed from each other, the space inside the flexible container being filled with a liquid of a suitable viscosity while the space between the container and the shell of the package is filled with a propellant gas.

Such an aerosol package is very favorable in respect of environmental protection as it does not release any emissions into the environment and the package can be reused hundreds of times, so it can be said that a package once bought is everlasting. The only problem with the package is its refilling. At present, containers are refilled using compressed air by pumping them full, but this is a slow and inaccurate filling method because measuring the volume of liquid pumped into the package or the pressure in the package with sufficient accuracy during the filling operation is difficult.

SUMMARY OF THE INVENTION

The object of the present invention is to eliminate the drawbacks mentioned above. A specific object of the invention is to present a new type of filling apparatus enabling refillable aerosol packages to be quickly and accurately refilled.

As for the features characteristic of the invention, reference is made to the claims.

The filling apparatus of the invention for the filling of refillable aerosol packages comprises a liquid container with a flow channel leading from the container via a pump into a nozzle which can be set into the valve of an aerosol package to open the valve and to transfer liquid into the liquid space of the aerosol package. The pump is connected to a power means, which preferably consists of an electric motor, for rotating the pump. According to the invention, the filling apparatus comprises a control unit controlling the apparatus, to which control unit is connected, besides the power means, a controlled valve placed in the flow channel just before the nozzle. In addition, according to the invention, connected to the control unit is also a flow meter placed between the pump and the valve for measuring the volume flow in the flow channel. Further, connected to the control unit is a starter for starting the filling procedure, i.e. rotation of the pump and opening of the controlled valve. Also, according to the invention, the flow channel is provided with a flow restrictor designed to prevent excessive flow especially at the initial stage of the filling process and to prevent a pressure drop on the delivery side, in other words, the pressure on the delivery side is kept at a sufficiently high and uniform level to allow a sufficiently accurate flow measurement.

The pump used is preferably a positive-displacement pump such as a geared pump, but it is also possible to use a suitable centrifugal pump.

The flow channel is preferably provided with a check valve to prevent a fall of pressure in the flow meter area when the pump stops. It is also possible to place the check valve in the pump, which means using a pump so constructed that it works in itself as a check valve.

The flow restrictor used in the filling apparatus of the invention may be e.g. a suitable throttling device which enables the liquid flow and at the same time the pressure drop in the flow meter area at the initial stage of the filling process to be kept within desired limits. Preferably the throttling device is one that works on a mechanical operating principle, in other words, the throttling device is not connected to the control unit of the apparatus but, once properly adjusted, works with sufficient accuracy.

The filling apparatus of the invention preferably uses a separate switch, such as a push button or equivalent, by means of which the filling apparatus is started after the aerosol package to be refilled has been placed against the nozzle. It is also possible to use a starter placed in the nozzle itself, in which case the apparatus is started automatically when the nozzle tube is inserted into the valve of the aerosol package. Other types of starters, such as a starter pedal, can also be used with the filling apparatus of the invention.

The filling apparatus of the invention is preferably provided with flushing valves allowing a flushing agent to be passed through the flow channel to cleanse the filling apparatus e.g. when the refill liquid is changed.

It is further possible within the scope of the inventive idea to divide the flow channel after the pump into at least two identical branches separately controlled by the control unit and leading to the nozzle. In this case, the same liquid container, the same pump and the same control unit can be used to fill multiple aerosol packages substantially simultaneously.

The filling apparatus of the invention is preferably provided with adjustable feedback which functions as a pressure relief device on the delivery side, so that, with the pump working continuously, the pressure remains at a steady maximum in the flow channel portion between the pump and the controlled valve. As the pressure used in aerosol packages is generally in the range of 8–9 bar and it need not be changed for each package or each liquid, the pressure relief device used in the feedback line can be a mechanical device, which, once adjusted, does not require any further adjustment.

The filling apparatus of the invention may be of a manually operated design, which means that the aerosol package is held in the hand and pushed against the nozzle of the filling apparatus for refilling. It is further possible to use various holders and supports on which the aerosol package is placed for refilling. Similarly, it is possible to use various filling lines along which the aerosol packages move to the filling apparatus and away from it.

The filling apparatus of the invention has significant advantages as compared with prior art solutions. The filling apparatus of the invention enables the quantity of liquid filled into the aerosol package to be accurately measured during the filling operation, thus making it unnecessary to check or weigh the packages after the refilling. In practice, the accuracy is about 1%. Therefore, it is unnecessary to measure the pressure of a refillable aerosol package and the filling can be performed very quickly. In experiments carried out on a prototype, it took only about 5 s to refill a 200-ml aerosol package. The filling apparatus of the invention allows easy and economic reuse of aerosol packages e.g. by implementing the filling apparatus as a coin-operated or card-operated automatic machine e.g. at service stations.

BRIEF DESCRIPTION OF THE DRAWING

In the following, the invention is described in detail by reference to the attached drawing in which.

DETAILED DESCRIPTION OF THE INVENTION

Figure 1:
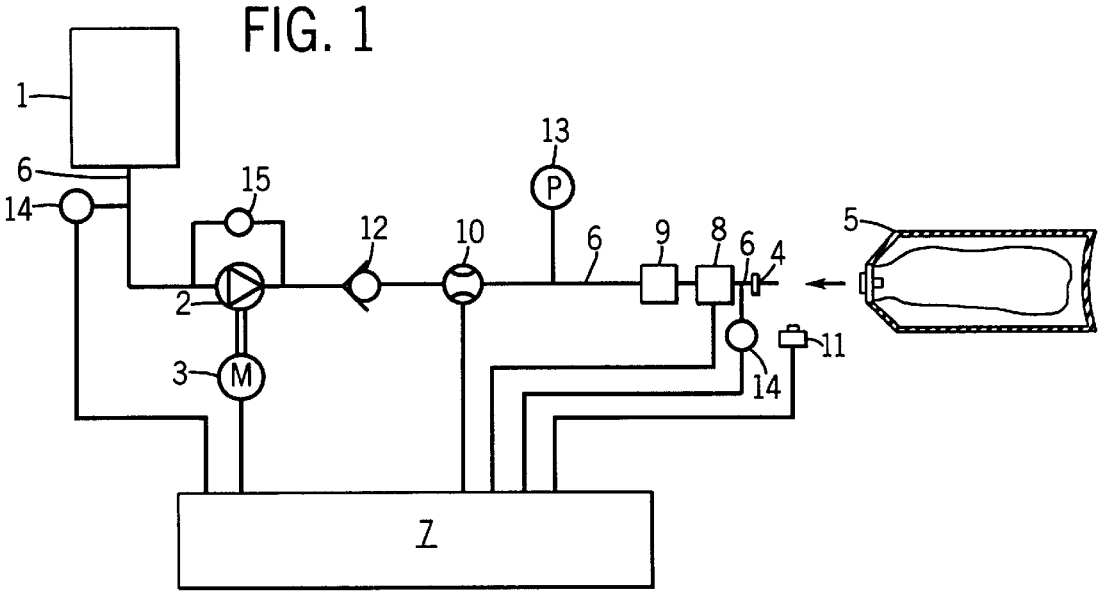
FIG. 1 is a diagrammatic view of a filling apparatus according to the invention.

The filling apparatus shown in the drawing comprises a liquid container 1 with a flow channel 6 from the container to a geared pump 2 rotated by an electric motor 3. From the pump, the flow channel 6 continues to a check valve 12 and further to a flow meter 10, after which there is a pressure gauge 13 connected to the flow channel. After the pressure gauge, the flow channel has a throttle 9 and after that a magnetic valve 8 with a nozzle 4 connected to it as an immediate extension. The structure of the nozzle may vary depending on whether the aerosol package to be filled has a male type or a female type valve. Moreover, the filling apparatus comprises a starter 11 and flushing valves 14 disposed at both ends of the flow channel 6.

The filling apparatus is controlled by a control unit 7, to which the motor 3, flow meter 10, magnetic valve 8, starter 11 and both of the flushing valves 14 are connected.

When the filling apparatus is to be used, the throttle 9 and the pressure relief device 15 is adjusted to the desired values or it has generally already been adjusted to suitable values and does not require further adjustment. After this, the desired filling quantity or the liquid volume to be supplied by the filling apparatus into the aerosol package at a time is programmed into the control unit 7. When the container 1 contains a sufficient amount of filling liquid, the filling apparatus requires no further adjustment but is ready to fill aerosol packages as follows.

The aerosol package 5 is pushed against the nozzle, in other words, the nozzle tube of the nozzle is inserted into the valve of the aerosol package, whereupon the starter button 11 is pressed. Controlled by the control unit 7, the motor 3 is now started and the magnetic valve 8 is opened at the same time. Due to the action of the throttle 9, the pressure prevailing in the pressure gauge 13 does not undergo any substantial variations even though the valve is opened. Therefore, the amount of liquid flowing through the flow meter can be accurately measured. This liquid quantity is very precisely the same as the liquid quantity discharged from the nozzle into the aerosol package, because the space between the check valve 12 and the magnetic valve 8 is always substantially at the same pressure and full of liquid and immediately after the magnetic valve 8 comes the nozzle 4, whose liquid volume is extremely small in relation to the filling volume of the aerosol package, generally only a fraction of a percent.

After the programmed amount of liquid has flowed through the flow meter 10, the control unit closes the magnetic valve 8 and the aerosol package has been filled with exactly the desired amount of filling liquid. At the same time, the motor 3 is generally also stopped while any overpressure is discharged via the feedback connection 15 back to the suction side of the motor. The check valve 12 keeps the pressure in the region of the flow meter 10 and throttle 9 at a constant level. After the valve 8 has been closed, the aerosol package is disengaged from the nozzle 4 and the next aerosol package to be filled can be connected to it in a corresponding manner.

When the filling apparatus is continuously used to fill larger numbers of aerosol packages, it is also possible to program the control unit 7 in such a way that the motor 3 and the pump 2 will run continuously and the control unit only controls the magnetic valve 8 at the start of operation, opening it as required by the flow measured by the flow meter 10.

Figure 2:
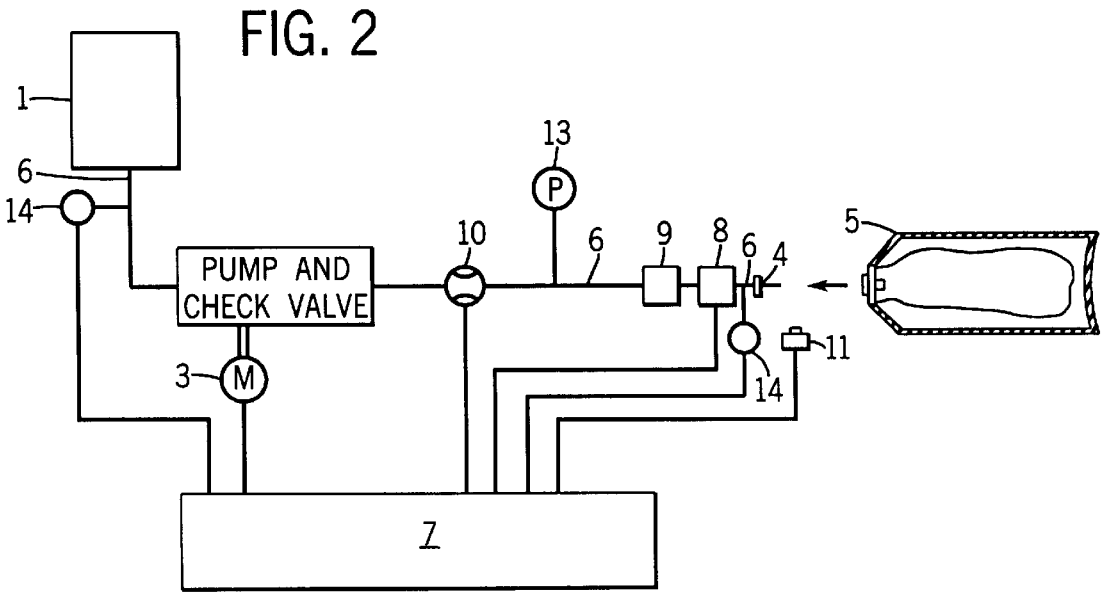
FIGS. 2, 3, and 4 are partial diagrammatic views showing modifications of the filling apparatus of FIG. 1.
Figure 3:
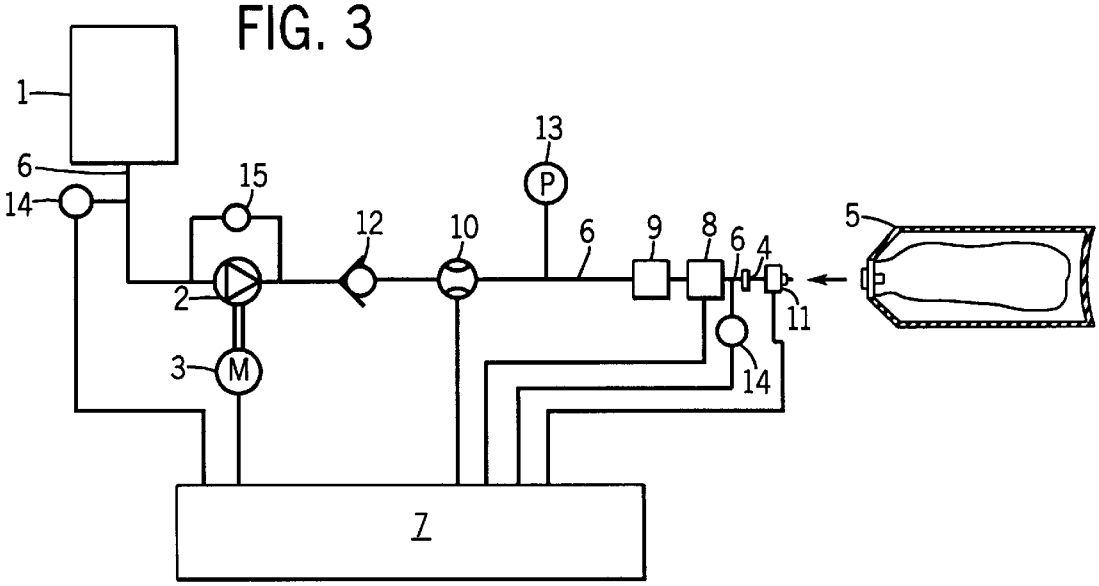
Figure 4:
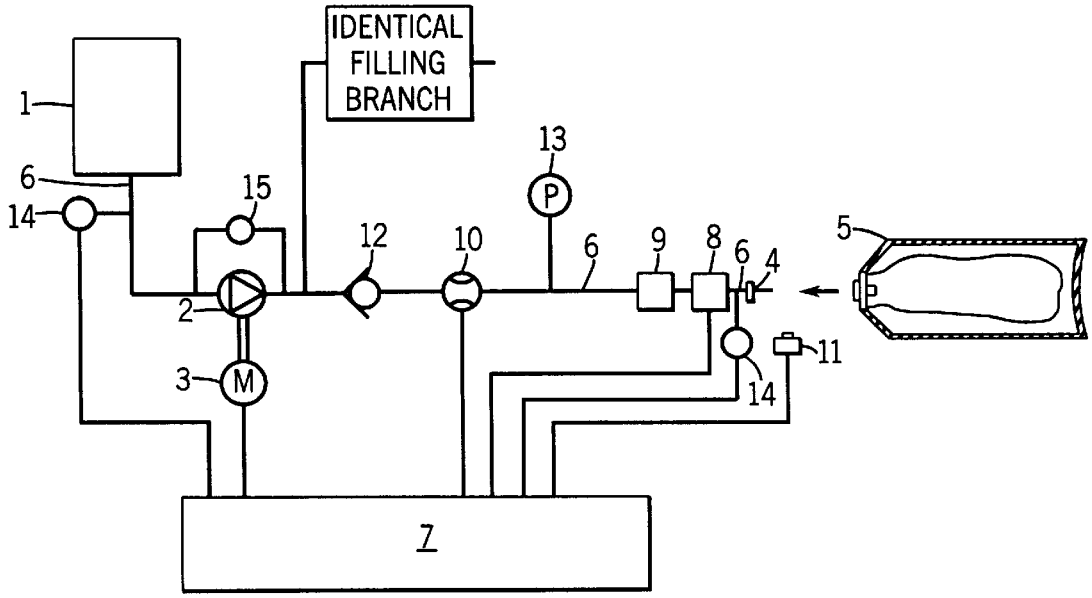

Check valve 12 can be combined with pump 2, as schematically shown in FIG. 2 or, pump may be so constructed that it works in itself as a check valve. As schematically shown in FIG. 3, starter 11 may be placed in nozzle 4 so that the apparatus is automatically started when the nozzle tube is inserted into the valve of aerosol package 5. As schematically shown in FIG. 4, the flow channel may be divided into two separate branches to fill multiple aerosol packages 5.

In the foregoing, the invention has been described by way of an example by the aid of the attached drawing, but different embodiments of the invention are possible within the scope of the inventive idea defined by the claims.

What is claimed is:

1. Filling apparatus for filling a refillable aerosol package, said filling apparatus comprising a liquid container (1), a pump (2) with a power means (3), a nozzle (4) for passing liquid into the aerosol package (5), and a flow channel (6) for passing liquid from the liquid container into the nozzle, characterized in that the filling apparatus comprises a control unit (7) to which control unit are connected, besides the power means (3), a controlled valve (8) placed in the flow channel (6) before the nozzle (4), a flow meter (10) placed between the pump (2) and the valve (8), and a starter (11), and that the flow channel is provided with a flow restrictor (9) placed before the valve (8).

2. Filling apparatus as defined in claim 1, characterized in that the flow channel (6) is provided with a check valve (12) placed before the flow meter (10).

3. Filling apparatus as defined in claim 2, characterized in that the check valve (12) is located between the pump (2) and the flow-meter (10).

4. Filling apparatus as defined in claim 2, characterized in that the check valve (12) is located in the pump (2).

5. Filling apparatus as defined in claim 1, characterized in that a feedback connection (15) is provided across the pump (2), said feedback connection acting as a pressure relief device.

6. Filling apparatus as defined in claim 1, characterized in that the flow channel is provided with a pressure gauge (13) located between the pressure relief device (9) and the check valve (12).

7. Filling apparatus as defined in claim 1, characterized in that the starter (11) is a separate switch.

8. Filling apparatus as defined in claim 1, characterized in that the starter (11) is placed in the nozzle, being thus activated when an aerosol package is pushed against the nozzle.

9. Filling apparatus as defined in claim 1, characterized in that the ends of the flow channel (6) are provided with flushing valves (14) to enable the flow channel (6) to be flushed in connection with a change of filling liquid.

10. Filling apparatus as defined in claim 1, characterized in that the flow channel (6) is divided after the pump (2) into at least two identical flow branches to allow at least two aerosol packages to be filled substantially simultaneously.

* * * * *